United States Patent [19]

Zandstra

[11] 3,978,958

[45] Sept. 7, 1976

[54] TICKET VENDOR

[75] Inventor: Lawrence Zandstra, Rockford, Mich.

[73] Assignee: Rowe International Inc., Whippany, N.J.

[22] Filed: Oct. 3, 1974

[21] Appl. No.: 511,594

[52] U.S. Cl. ..... 194/2; 194/10; 221/22; 221/30; 226/195; 83/210; 83/365

[51] Int. Cl.[2] ..... G07F 11/00

[58] Field of Search ..... 221/22, 25, 30; 194/1 R, 1 N, 2, 4 R, DIG. 8, 2, 10; 226/195; 83/358, 359, 365, 203, 210

[56] References Cited

UNITED STATES PATENTS

| | | | |
|---|---|---|---|
| 1,919,652 | 7/1933 | Helsel | 83/358 X |
| 2,458,612 | 1/1949 | Luzzatto et al. | 83/210 |
| 3,137,190 | 6/1964 | Mosher et al. | 83/210 |
| 3,319,820 | 5/1967 | Matsuda et al. | 221/25 |

FOREIGN PATENTS OR APPLICATIONS

| | | | |
|---|---|---|---|
| 633,635 | 6/1963 | Belgium | 194/25 |

*Primary Examiner*—Robert B. Reeves
*Assistant Examiner*—Joseph J. Rolla
*Attorney, Agent, or Firm*—Shenier & O'Connor

[57] ABSTRACT

Apparatus for severing tickets from a supply of connected tickets and for feeding severed tickets individually to a delivery location in response to a credit signal in which an already severed ticket, retained in escrow position at which it blocks the path of light from a source to a photocell, is advanced by first drive rollers energized in response to a credit signal to the delivery area and in which the photocell is energized as the trailing edge of the delivered ticket passes out of the path of light from the source to the photocell to cock a cutter disposed between the supply of tickets and the escrow position and to activate second relatively slower drive rollers to advance a ticket from the supply to the first relatively faster drive rollers which picks up the ticket, pulls it taut, and moves it to a position at which the leading portion thereof interrupts the path of light from the light source to the photocell to deenergize the cutter cocking solenoid, both drive rollers, and the source of illumination to cause the cutter to cut the latter ticket accurately at the line of perforations connecting it to the next ticket in the supply. A support member is provided for adjusting the positions of the light source and photocell along the path of tickets readily to accommodate tickets of different lengths.

14 Claims, 4 Drawing Figures

TICKET VENDOR

BACKGROUND OF THE INVENTION

There are known in the prior art various arrangements for delivering tickets from a roll or from a stack of connected tickets. One example of such a system is shown in Verduin et al., U.S. Pat. No. 3,770,089. In that arrangement credit is established selectively to permit a customer to obtain a number of lower priced lottery tickets, for example, or a single higher priced lottery ticket. In response to a credit established in the machine, a push button or the like is actuated to cause a ticket or tickets from the selected supply to be moved past a cutter which is operated to sever the ticket or tickets from the supply. Tickets are advanced by means of a pinwheel which engages in perforations in the edges of the tickets. Cut off is accomplished by means of a cam driven lever and knife. While the arrangement shown in the Verduin et al., patent is generally satisfactory, it incorporates a number of drawbacks. No means is provided for avoiding the possibility of cumulative errors in the cutting mechanism. No provision is made for adjusting the mechanism to accommodate a range of ticket lengths. It is not completely automatic.

Riddle et al., U.S. Pat. No. 3,621,964 shows a mechanism for automatically delivering a predetermined number of stamps from a supply roll of stamps. Upon the establishment of credit aggregating the cost of the number of stamps desired, drive means, including a pair of drive belts, is energized to carry stamps from the supply roll toward the machine exit. A cutter mounted for reciprocating movement at the exit normally is biased to a position at which it blocks the passage of stamps out of the machine. When the drive means is energized, the cutter is moved against the action of its biasing means to a position at which an opening therein registers with the exit opening of the machine so that stamps can pass out of the machine. A photocell and light source adjacent to the machine exit count the number of stamps which have passed out of the exit by virtue of light passing through the perforations connecting adjacent stamps. When the number of stamps corresponding to the established credit has passed out of the machine, the drive is stopped and the cutter is released to cut the stamps from the supply.

The arrangement of Riddle et al. involves a number of defects which render it unsuitable for delivering articles such as lottery tickets or the like. First, no provision is made therein for accommodating a range of lengths of tickets. No provision is made for accounting for minor inaccuracies in the cutting operation resulting from a lack of tension in the string of stamps being pulled from the roll. Such minor inaccuracies may become cumulative with the result that the operation of the machine is entirely unsatisfactory. The arrangement is moveover relatively complicated and expensive to construct, thus rendering it unsuitable for a system in which dispensing machines must be installed at a very large number of locations.

I have invented a ticket dispensing mechanism which overcomes the defects of ticket delivery mechanisms of the prior art. My apparatus operates entirely automatically in response to the establishment of credit. It is able to accommodate a range of ticket sizes. It is more certain in operation than are machines of the prior art. It minimizes the possibility of minor errors in severing tickets which may become cumulative. It is rapid in operation. It is relatively simple and is inexpensive to construct.

SUMMARY OF THE INVENTION

One object of my invention is to provide a ticket vendor which is especially adapted to vend articles such as lottery tickets.

Another object of my invention is to provide a ticket vendor which minimizes the possibility of a cumulative error in cutting of tickets from a supply.

A further object of my invention is to provide a ticket vendor which will accommodate a range of ticket lengths.

Yet another object of my invention is to provide a ticket vendor which cuts tickets from a supply and which is certain in operation.

A still further object of my invention is to provide a ticket vendor which is simple and inexpensive to construct.

A still further object of my invention is to provide a ticket vendor which is rapid in operation.

Other and further objects of my invention will appear from the following description.

In general my invention contemplates the provision of a ticket vendor in which a first drive means normally holds a severed ticket in an escrow position at which it interrupts the path of light between a source and a photocell. In response to the establishment of a credit, this first drive means is energized to deliver the escrow ticket. When the trailing edge of the ticket being delivered moves out of the path between the light source and the photocell, the cutter is moved to a cocked position and the second relatively slower drive means is energized to move a ticket from the supply toward the first drive means which picks up the ticket and moves it toward the escrow position until the leading portion thereof interrupts the path of light between the source and the detector. In the course of that operation, the length of tickets extending from the second drive means to the first drive means is drawn taut. The distance between the cutter and the path of light to the detector is equal to the length of a ticket between lines of perforations so that, when the leading edge of a ticket from the supply interrupts the path of light, the line of perforations connecting it to the remaining tickets is precisely aligned with the cutter. At the time the path of light is again interrupted, both of the drive means are stopped, the light source is extinguished, and the cutter is released so that it cuts the ticket precisely along the line of perforations. I provide means for adjusting the position of the path of light from the source to the detector along the path of movement of a ticket, thus to accommodate a range of ticket lengths.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
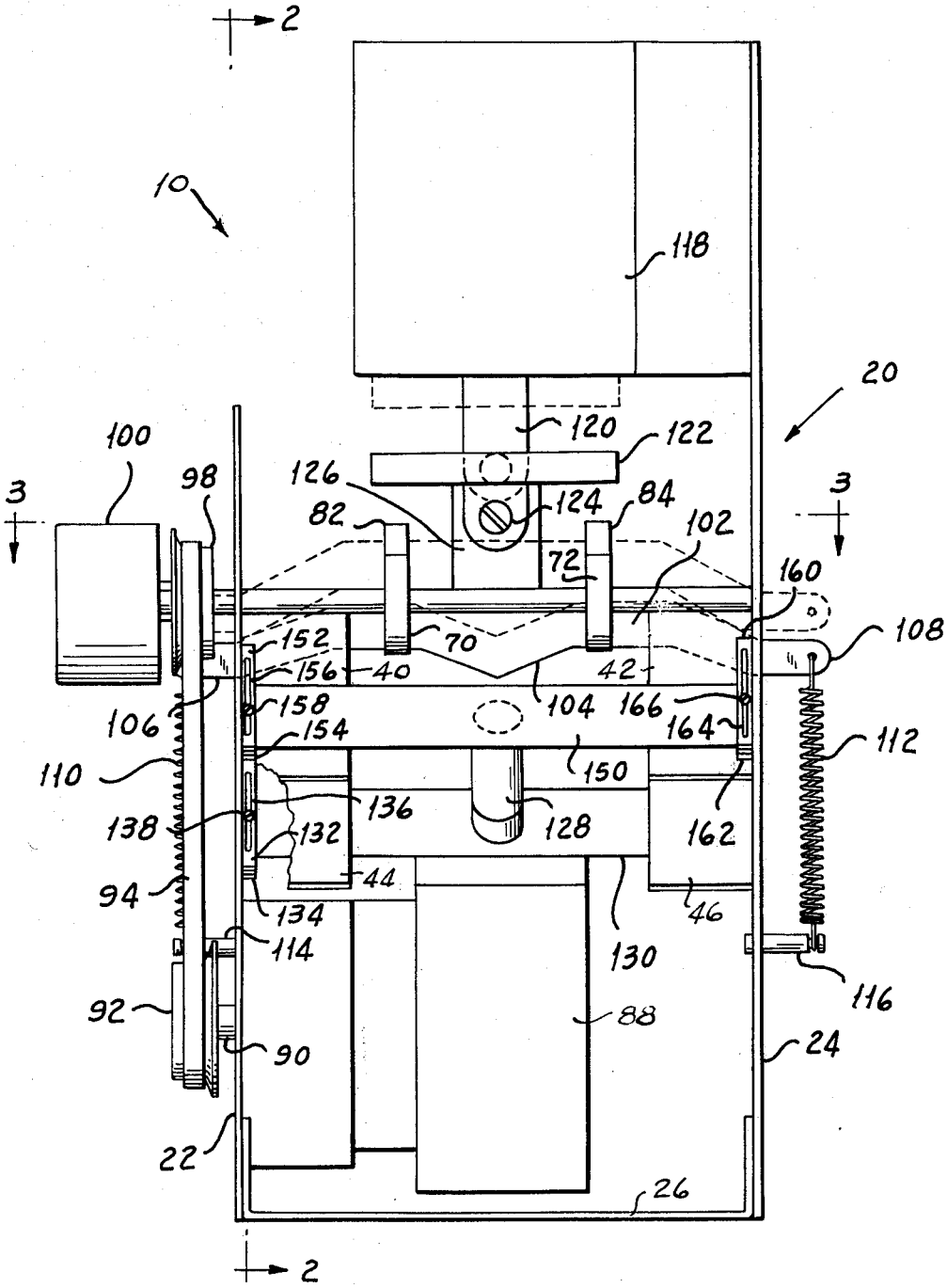
FIG. 1 is a front elevation of my ticket vendor with the casing removed.
Figure 2:
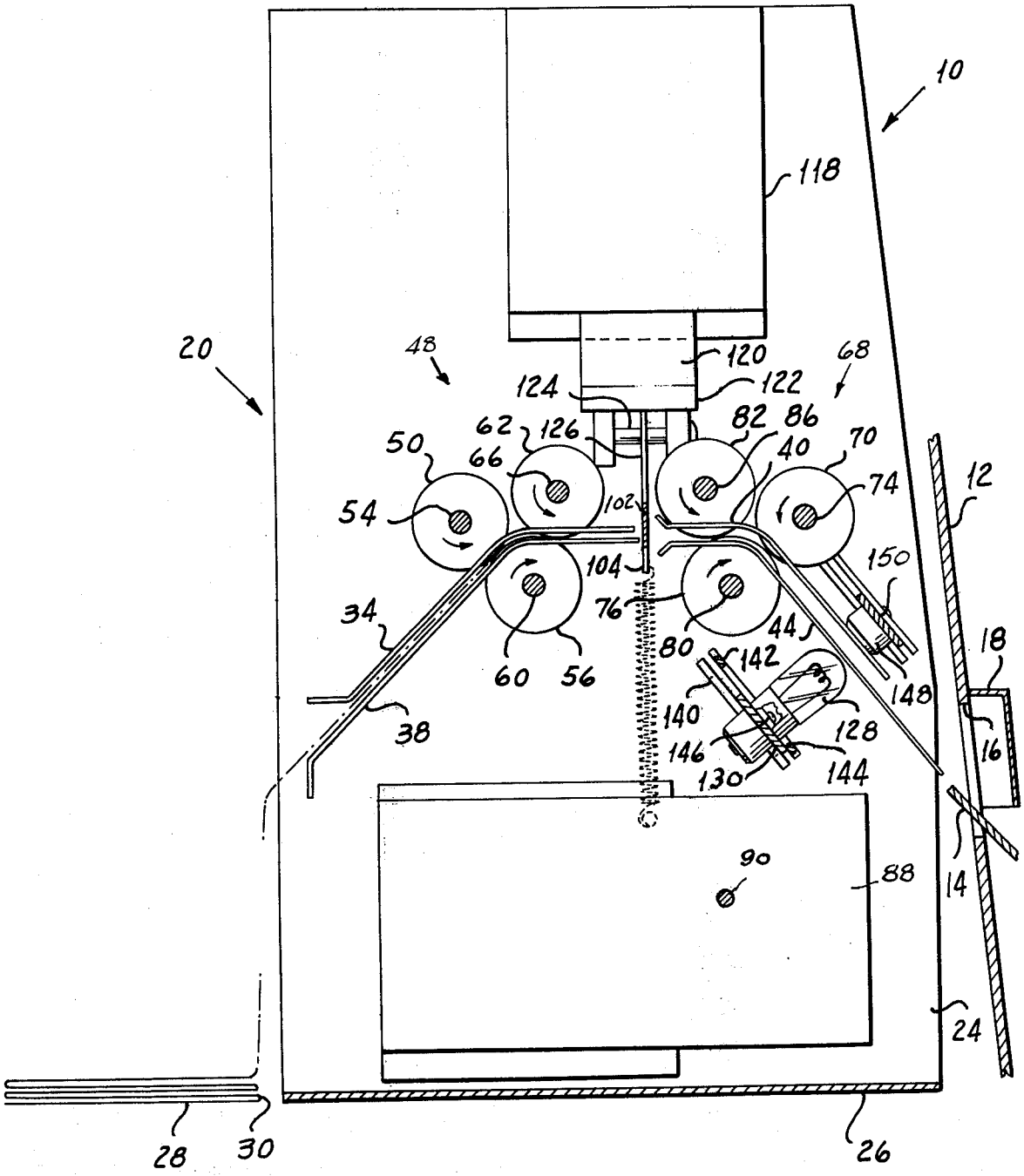
FIG. 2 is a sectional view of my ticket vendor taken along the line 2—2 of FIG. 1.
Figure 3:
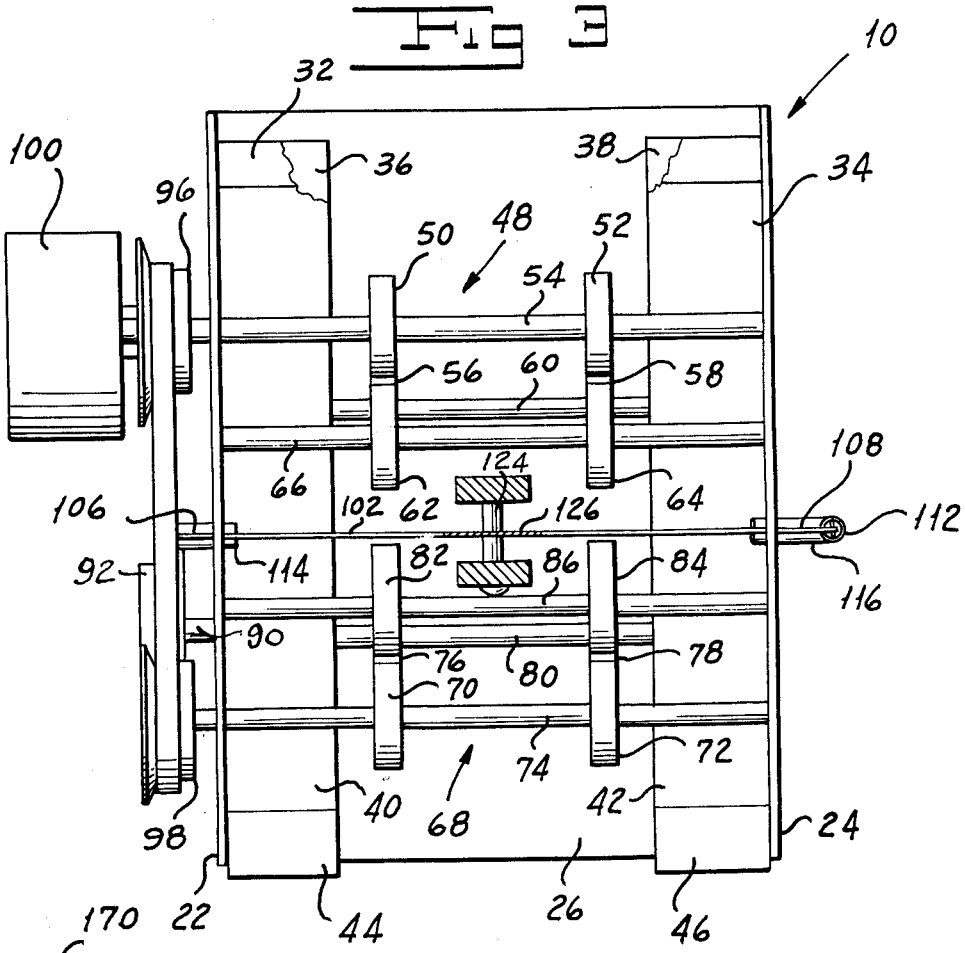
FIG. 3 is a sectional view of my ticket vendor taken along the line 3—3 of FIG. 1.

Referring now to FIGS. 1 to 3 of the drawings, my ticket vendor, indicated generally by the reference character 10, includes a front cabinet wall 12 provided with a delivery guide 14 mounted in an opening 16 in the wall 12. A hood 18 secured to the wall 12 over the opening 16 prevents access to the interior of the cabinet.

The frame, indicated generally by the reference character 20, of my machine includes sides 22 and 24, and a base 26 secured between the sides by any suitable means. My vendor is adapted to dispense tickets 28 connected along lines of perforations 30 and normally folded with a fan or accordion fold to provide a supply of tickets 28.

Tickets 28 from the supply are adapted to be threaded between pairs of guides comprising rear upper guides 32 and 34 and rear lower guides 36 and 38. In a manner to be described, tickets from the supply, after passing through the guides 32, 34, 36 and 38, advance to the spaces between pairs of front guides, including front upper guides 40 and 42 and front lower guides 46 and 48. As will be apparent from the showing of FIG. 2, the leading edges of the guides 40, 42, 44, and 46 form a mouth to facilitate the entry of tickets into the spaces between the guides. A ticket held in escrow, in a manner to be described, is delivered from the lower guides 46 and 48 to the delivery guide or tray 14.

The ticket delivery mechanism of my vendor 10 includes a rear roller set, indicated generally by the reference character 48, made up, in part, of a pair of upper drive rollers 50 and 52 carried by a shaft 54 for rotation therewith. Spaced rear driven rollers 56 and 58 are mounted on a shaft 60. Drive rollers 50 and 52 respectively engage the driven rollers 56 and 58, the pairs of rollers forming nips therebetween. A pair of rear guide rollers 62 and 64 carried by a shaft 66 engage the respective rollers 56 and 58 so as to be driven thereby. As will be apparent from the description hereinbelow, the rear set of rollers 48 form one drive means of my vendor.

I provide my vendor with a front group of rollers, indicated generally by the reference character 68. The group 68 includes a pair of upper drive rolls 70 and 72 mounted in spaced relationship on a shaft 74. Lower driven rolls 76 and 78 carried by shaft 80 respectively engage the upper drive rolls 70 and 72 so as to be driven thereby. Guide rolls 82 and 84, mounted in spaced relationship on a shaft 86, respectively engage the driven rolls 76 and 78 so as to be driven thereby.

I provide my vendor with a drive motor 88 having an output shaft 90 carrying a pulley 92 for rotation therewith. Pulley 92 receives a belt 94 which extends around a rear pulley 96 and around a front pulley 98. The front pulley 98 is carried by shaft 74 for rotation therewith, so that shaft 74 is driven for the period of time during which the motor 88 is energized. A clutch 100 of any suitable type known to the art is adapted to be energized to clutch pulley 96 to the shaft 54 so that shaft 54 is driven only when both motor 88 and clutch 100 are energized. In addition to the foregoing, I so construct my vendor that the front pulley 98 has a relatively smaller diameter than does the rear pulley 96. Thus, when both motor 88 and the clutch 100 are energized, the front set 68 of rollers is driven at a somewhat greater speed than is the rear set 48 of rollers. As will more fully be apparent from the description hereinbelow, owing to the fact that the front rollers 68 are driven faster than are the rear rollers 48, the ticket or tickets 28 extending between the two sets of rollers will be tensioned to permit accurate cutting along a line of perforations 30 separating a pair of adjacent tickets.

My vendor includes a cutter 102 disposed along the path of movement of a ticket between the exits from the rear guides 32, 34, 36, and 38, and the entrance to the front guides 40, 42, 44, and 46. Cutter 102 includes a central generally V-shaped portion 104 which facilitates entry of the cutter into the material of the ticket along the line of perforations connecting adjacent tickets. I form the cutter 102 with a pair of lateral extensions 106 and 108 extending outwardly through vertical slots, or the like, in the side walls 22 and 24, thus to mount the cutter for vertical reciprocating movement across the path of travel of tickets 28. Respective springs 110 and 112, connected to the outer ends of extensions 106 and 108 outside of the walls 22 and 24, are connected at their other ends to pins 114 and 116 carried by the sides 22 and 24 so as normally to bias the cutter 102 to a lower limit position at which the cutter blocks the path of tickets between the exits of the rear guides and the entrances of the front guides.

A solenoid 118 supported, for example, on wall 24 by any suitable means, has an armature 120 provided with a stop 122 which limits the upward movement of the armature to the broken line position illustrated in FIG. 1. A centrally-located upward extension 126 on the cutter 102 receives a bolt 124, or the like, carried by bifurcations at the lower end of the armature 120.

I provide the vendor 10 with adjustably positioned photoelectric means for detecting the presence of a ticket 28 in an escrow position in which the ticket is held by the front group 68 of rollers. This photoelectric means includes a lamp 128 supported in a plate 130. I mount the left hand edge of the plate 130, as viewed in FIG. 1, in the space between respective upper and lower guide elements 132 and 134. I provide the upper guide element 132 with a slot 136 adapted to receive a screw 138 threaded into the left hand edge of the plate 130 and adapted to hold the left hand edge of the plate 130 in a position along the length of the path of travel of a ticket to which it has been adjusted. The right hand edge of the plate 130 is received in the space between upper and lower guides 142 and 140. I provide the upper guide 142 with a slot 144 adapted to receive a screw 146, or the like, threaded into the right hand edge of the plate 130 so as to hold this edge of the plate in the position along the path of movement of a ticket to which it has been adjusted.

The photoelectric detector system includes a photosensitive detector 148 mounted on a plate 150. I provide means similar to that which supports plate 130 for supporting the plate 150 in an adjusted position along the length of the path of a ticket passing through the vendor. Respective upper and lower guides 152 and 154 carried by the wall 22 provide a space for receiving the left hand edge of the plate 150. I provide the upper guide 152, for example, with a slot 156 adapted to receive a screw 158 threaded into the left hand edge of the plate 150, as viewed in FIG. 1, to hold the plate in a position along the length of the path of a ticket to which the plate has been adjusted. Respective spaced right hand upper and lower guides 160 and 162 receive the right hand edge of plate 150, as viewed in FIG. 1.

Guide 160 is formed with a slot 164 adapted to receive a screw 166 threaded into the right hand edge of the plate 150 to hold the plate in a position to which it has been adjusted.

From the structure just described, it will be apparent that the light source 128 and the photodetector 148 may easily be aligned with each other, and that the path of light from the source 128 to the detector 148 may be adjusted along the length of the path of travel of a ticket passing through the vendor 10, so as to accommodate tickets of different lengths in a manner to be described.

Figure 4:
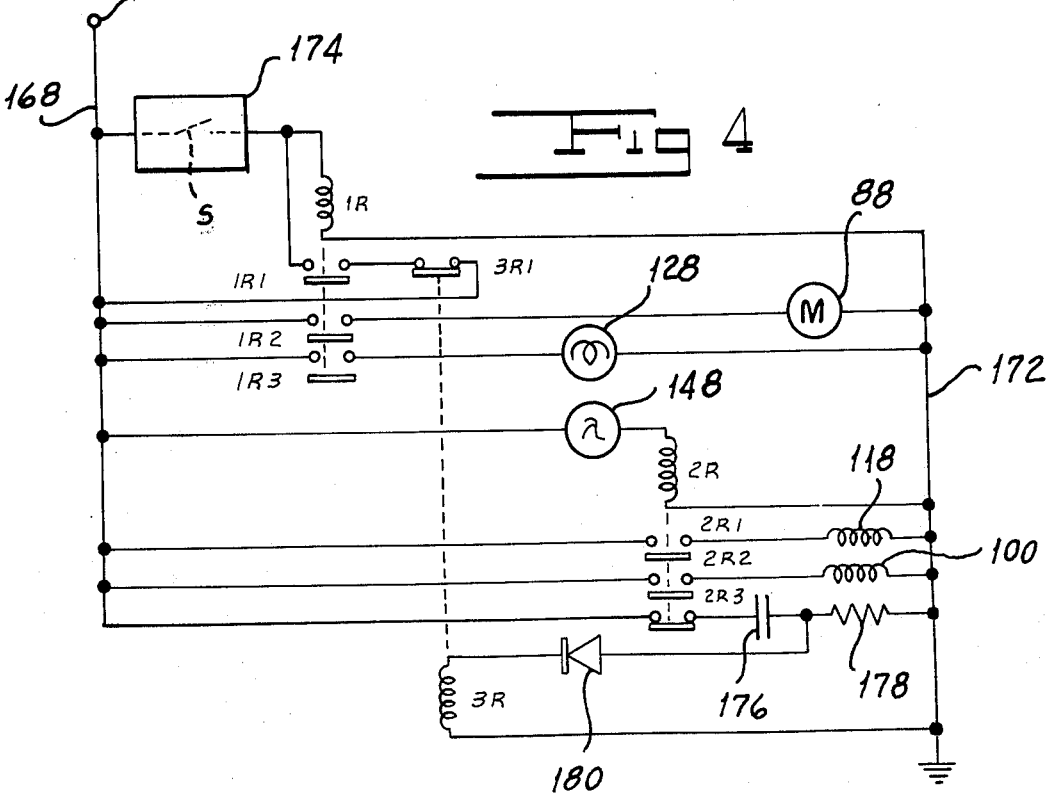
FIG. 4 is a schematic view of one form of electrical circuit which may be used to control the operation of my ticket vendor.

Referring now to FIG. 4, one form of control circuit which may be employed to control the operation of my ticket vendor 10 includes a first line 168 connected to the terminal 170 of a suitable source of potential and a ground line 172. I connect a money-responsive device 174 of any suitable type known to the art in series with a winding 1R between conductors 168 and 172. As is known in the art, the device 174 is adapted to close a switch S to energize relay winding 1R when a certain sum has been deposited in the money-responsive device 174. When winding 1R is thus energized, it closes a first set of switch contacts 1R-1 to complete its own holding circuit through a normally-closed pair of switch contacts 3R-1. At the same time, it closes a second set of switch contacts 1R-2 to energize motor 88. It will be remembered that at this time neither the solenoid 118 nor the clutch 100 is energized. Under these conditions, the rollers of the front group 68 are driven to move a ticket which had been held in escrow, in a manner to be described, outwardly toward the delivery guide 14, at which it is received by the customer.

Further, when winding 1R is energized, a normally-open set of switch contacts 1R-3 close to energize the light source 128. At this time, however, light from the source 128 will not activate the photodetector 148 owing to the presence of the escrow ticket in the path between the light source 128 and the detector 148. As the escrow ticket moves down the lower guide 148, ultimately its trailing edge moves out of the path of light between the source 128 and the detector 148. When that occurs, sufficient light from the source 128 falls on the detector 148 to render the latter conductive to energize a relay winding 2R connected in series with detector 148 between lines 168 and 172.

Energization of the winding 2R closes a first set of normally-open switch contacts 2R-1 to energize the solenoid winding 118 to draw the armature 120 upwardly to the broken line position illustrated in FIG. 1. In this position of the armature, the knife 102 has been moved to a position at which it is out of the path of a ticket moving from the rear guides toward the front guides.

Energization of winding 2R further closes a set of normally-open switch contacts 2R-2 to energize the clutch winding 100 to clutch the pulley 96 to the shaft 54 to drive the rear set of rollers 48. When these rollers are driven, they advance the leading ticket of the string extending back to the supply into the front guides 40, 42, 44, and 46 and into the nip formed between the pairs of rollers 76 and 78 and 82 and 84. The forward set of rollers 68 carry this leading ticket toward the escrow position determined by the position of the light source 128 and photocell 148. As has been pointed out hereinabove, the pulley 98 is of a somewhat smaller diameter than is the pulley 96, so that the front set of rollers 68 are driven at a slightly greater speed than are the rear set of rollers 48. Owing to this fact, the leading ticket from the supply is drawn taut as it is picked up by the front set of rollers 68. Moreover, the distance along the path of travel of the ticket between the location of the knife 102 and the point at which the leading edge of the ticket cuts off light from source 128 to detector 148 is precisely equal to the length of the ticket. Thus, when the leading edge of the ticket arrives at the point at which light from source 128 to detector 148 is cut off, the line of perforations connecting this leading ticket to the next ticket is precisely aligned with knife 102. This position of the ticket can readily be adjusted by adjusting the positions of the source 128 and detector 148.

It is to be noted that energization of winding 2R when the trailing edge of the escrow ticket leaves the space between the source 128 and detector 148, also opens a pair of normally-closed switch contacts 2R-3 connected in series with a capacitor 176 and a resistor 178 between lines 168 and 172. When, in the manner described, the leading edge of the ticket being advanced from the supply interrupts the path of light from source 128 to detector 148, winding 2R is deenergized.

When winding 2R is deenergized, contacts 2R-1 open to deenergize winding 118. When this occurs springs 110 and 112 pull knife 102 downwardly to sever the leading ticket from the supply along the line of perforations connecting this ticket to the next ticket in the supply. Contacts 2R-2 open to deenergize clutch 100 to interrupt the drive of the rear rollers 48.

Finally, when winding 2R is deenergized, contacts 2R-3 close to connect the R-C circuit made up of capacitor 176 and resistor 178 to line 168. This results in a positive going pulse at the common terminal of capacitor 176 and resistor 178. A diode 180 connects this common terminal to one terminal of a relay winding 3R, the other terminal of which is connected to the line 172. When the positive going pulse is thus applied to winding 3R, it opens switch contacts 3R-1 to interrupt the holding circuit of 1R to restore the control circuit to its quiescent state.

Setting up of my vendor 10 by the operator is a relatively simple matter. A fan or accordion folded stack of tickets 28 is placed in the cabinet behind the operating mechanism and the first ticket is threaded into the space between the guides 32 and 34, and 36 and 38 and advanced manually to a position at which it can be picked up by the nips between the pairs of rollers 50 and 56, and 52 and 58. Next, the operator closes the switch S either manually or by depositing the required amount of money in the money-responsive mechanism 174. Under these conditions, relay 1R closes to close its switch contacts 1R-1, 1R-2 and 1R-3 to energize motor 88 and lamp 128. Since, under these conditions, no ticket is held in escrow, light from the source 128 immediately renders the photodetector 148 conductive to energize relay winding 2R to close its contacts 2R-1 and 2R-2 and to open its normally-closed contacts 2R-3. When this occurs, solenoid winding 118 is energized and clutch 100 is energized so that the rollers of the rear set are driven. The leading ticket from the supply moves into the space between the front guides until it is picked up by the rollers of the front set 68 which draw the ticket taut and advance it to a position at which the leading edge thereof cuts off light from the source 128 impinging on the detector 148. When that occurs, clutch 100 is deenergized, and solenoid winding 118 is deenergized to cause the springs 110 and 112 to drive the knife 102 downwardly to cut the leading ticket from the supply. At the same time, winding 3R receives a pulse to deenergize relay winding 1R to return the control circuit to its quiescent state.

Before carrying out the operations described above, the operator sets the plates 130 and 150 to a position along the path of travel of a ticket so that the distance between the knife 102 and the location of the plates 130 and 150 corresponds approximately to the length of a ticket. After the first operation described above, the operator preferably carries out a second test operation to observe whether or not the source 128 and detector 148 have been properly positioned to cause the knife 102 to sever the ticket precisely along the line of perforations connecting it to the following ticket. If not, an adjustment can be made. Such adjustment most likely will only be required when tickets of a different size are being placed in the vendor 10.

After the operations described above have been carried out, the vendor 10 is ready for normal operation. In normal operation a customer desiring to purchase a ticket deposits a sum equal to the price of the ticket in the mechanism 174 to close switch S. When that occurs the front rollers 68 are driven to deliver the escrow ticket to the customer. When the trailing edge of the escrow ticket leaves the space between the source 128 and the photocell 148, winding 118 is energized to cock the knife 102, and the rear drive rolls 48 are driven to advance the leading ticket from the supply to the front guides. When the leading edge of this ticket cuts off the light from the source 128 to the detector 148, winding 118 is deenergized to cut the ticket, the clutch 100 is deenergized, and winding 3R receives a pulse to interrupt the holding circuit of winding 1R to deenergize motor 88 and to extinguish the light 128.

It will be seen that I have accomplished the objects of my invention. I have provided a ticket vendor which will accommodate a range of ticket lengths. My ticket vendor ensures that adjacent tickets are accurately severed along the line of perforations separating adjacent tickets to prevent cumulative error in the cutting operation. It is rapid in operation. It is easily set up for operation. My ticket vendor is simple in construction and is inexpensive to manufacture.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for dispensing individual tickets from a supply of connected tickets to a delivery opening in response to a credit signal including in combination a cabinet, means forming a delivery opening in said cabinet through which individual tickets are to be delivered to customers, a supply location in said cabinet for receiving a supply of tickets, means forming a path for movement of tickets from said supply to said delivery opening, said path including an escrow location between said supply location and said delivery opening at which escrow location a severed ticket held thereat is inaccessible from outside said cabinet, means at said escrow location for holding a severed ticket, means responsive to said credit signal for advancing said severed ticket from said escrow location to said delivery opening, means responsive to movement of said severed ticket out of said escrow location for moving a ticket from said supply toward said escrow position, and means responsive to movement of said ticket from said supply into said escrow location for severing said ticket from said supply, said means responsive to movement of said ticket from said supply location into said escrow location comprises means for sensing the presence of a ticket in said escrow location and means for adjusting the position of said sensing means along the path of movement of a ticket from said supply to said delivery opening.

2. Apparatus as in claim 1 including means for tensioning a ticket moving from said supply toward said escrow position.

3. Apparatus as in claim 1 in which said sensing means comprises means for sensing the leading edge of a ticket moving into said escrow location.

4. Apparatus as in claim 3 in which said sensing means comprises a light source located at one side of said ticket path and a photosensitive element located at the other side of said path.

5. Apparatus for dispensing individual tickets from a supply of connected tickets to a delivery opening including in combination, a cabinet, means forming a delivery opening in said cabinet through which individual tickets are to be delivered to customers, a supply location in said cabinet for receiving a supply of tickets, means forming a path for movement of tickets from said supply to said discharge opening, said path including an escrow location between said supply location and said discharge opening and at which escrow location a severed ticket held thereat is inaccessible from outside said cabinet, a cutting means mounted at a location along said path between said supply location and said escrow location, first drive means between said supply location and said cutter for receiving the leading ticket of said supply, second drive means between said cutter and said discharge opening for holding a cut ticket at said escrow location, means for sensing the presence of said ticket at said escrow location, means for activating said second drive means to move said cut ticket from said escrow location to said delivery opening, means including said sensing means responsive to movement of said cut ticket out of said escrow position for energizing said first drive means to advance said leading ticket to said second drive means, and means including said sensing means responsive to arrival of said leading ticket in said escrow position for causing said cutting means to sever the trailing edge of said leading ticket and for deenergizing said first and second drive means.

6. Apparatus as in claim 5 in which said second drive means activating means comprises means responsive to the deposit of money therein.

7. Apparatus as in claim 5 in which said second drive means operates at a greater speed than does said first drive means whereby to tension a length of tickets including said leading ticket extending between said drive means.

8. Apparatus as in claim 5 in which said cutting means comprises a cutter blade, means mounting said cutter blade for movement across said path between a first position in said path and a second position out of said path and means for biasing said cutter blade to said first position, said apparatus comprising means including said sensing means responsive to movement of said cut ticket out of said escrow location for moving said cutter from said first position against the action of said biasing means, and in which said means for causing said cutting means to sever comprises means for deactivating said blade moving means.

9. Apparatus as in claim 8 in which said blade moving means comprises means for holding said blade cocked in said second position against the action of said biasing means.

10. Apparatus as in claim 9 in which said cutter moving means comprises a solenoid.

11. Apparatus as in claim 5 including means for adjusting the position of said sensing means along said ticket path.

12. Apparatus as in claim 11 in which said sensing means senses the leading portion of a ticket, said adjusting means permitting adjustment of said sensing means to a point at which the distance along said path between said cutting means and said sensing means is equal to the length of a ticket.

13. Apparatus as in claim 5 in which said second drive means operates at a greater rate than does said first drive means whereby to tension a length of tickets including said leading ticket extending between said drive means, said apparatus including means for adjusting the position of said sensing means along said ticket path.

14. Apparatus as in claim 13 in which said cutting means comprises a blade and means for biasing said blade to said first position, and in which said apparatus comprises means including said sensing means for holding said blade corked in said second position against the action of said biasing means.

* * * * *